US005129486A

United States Patent [19]

Steacy et al.

[11] Patent Number: 5,129,486

[45] Date of Patent: Jul. 14, 1992

[54] ELEVATOR DOOR LOCK

[75] Inventors: Robert J. Steacy, Collinsville; Christian G. Tonna, New Britain, both of Conn.

[73] Assignee: Otis Elevator Company, Farmington, Conn.

[21] Appl. No.: 607,438

[22] Filed: Oct. 31, 1990

[51] Int. Cl.[5] ..... B66B 13/00

[52] U.S. Cl. ..... 187/52 LC; 157/61

[58] Field of Search ..... 487/52 LC, 61, 51, 52 R, 487/56, 57; 49/116, 120

[56] References Cited

U.S. PATENT DOCUMENTS

| | | | |
|---|---|---|---|
| 2,235,380 | 3/1941 | McCormick | 187/52 LC |
| 2,859,835 | 11/1958 | Borden | 187/52 LC |
| 2,960,188 | 11/1960 | Schweig | 187/52 LC |
| 3,065,826 | 11/1962 | Tucker, Jr. | 187/52 LC |

*Primary Examiner*—Robert P. Olszewski
*Assistant Examiner*—Kenneth Noland
*Attorney, Agent, or Firm*—Lloyd D. Doigan

[57] ABSTRACT

A center opening, linkage driven elevator door system comprises: a single door lock; an air cord; a first hoistway door attached to the air cord; a second hoistway door having a stop in register with the air cord, the second hoistway door being locked by said lock; an abutment attaching to the air cord, the abutment contacting the stop attached to the second hoistway door when the first and second hoistway doors are closed such that the first hoistway door cannot move when the second hoistway door is locked, the abutment not contacting the stop during the opening of the doors due to the different relative speeds of the first and second hoistway doors.

5 Claims, 3 Drawing Sheets

ELEVATOR DOOR LOCK

TECHNICAL FIELD

This device relates to an elevator door lock, and more particularly to a door lock for a center opening elevator door system utilizing a two vanes and a linkage.

BACKGROUND ART

Center opening elevator door systems consist of a pair of car doors and a pair of hoistway doors. Each pair of doors open and close about a central point in an elevator doorway.

Linkages are used to open and close center opening elevator door systems. A door operating unit attaches to each car door via the linkage. Due to the arrangement of the linkages relative to the door operating unit and each door, it is known that one car door will move at a varying speeds relative to the other car door.

In a typical linkage driven elevator door system, a single vane is disposed between a first car door and a first hoistway door. As the car doors opens or closes, driven by the linkages, the first hoistway door opens or closes with the first car door due to the connection via the vane.

The two hoistway doors are fixedly connected by a cord (known in the art as an air cord) disposed about a pair of pulleys. As the first hoistway door opens or closes, the second hoistway door also opens or closes due to its connection via the air cord. Because the hoistway doors are connected via the air cord, they travel at the same speed as each other. The hoistway doors also travel at the same speed as the first car door due to their attachment to the vane. However, the second car door travels at a different speed than the first car door and the hoistway doors.

Because the hoistway doors are fixedly connected by the air cord, a single door lock may be utilized. By locking one hoistway door, the other door is necessarily locked due to its attachment via the air cord.

It is desirable to utilize a two vane system in high performance door systems. A two vane system couples each car door to a respective hoistway door by means of a vane. This type of system is shown in Voser U.S. Pat. No. 3,783,977 which shows a linkage that utilizes two vanes. Such a system allows the hoistway door and car door open and close in register in a smooth manner. However, a separate door lock for each hoistway door is required. Two door locks are undesirable because of electrical and maintenance requirements, complexity, and cost.

Disclosure of the Invention

It is an object of the invention to provide a high performance door lock which operates smoothly with a minimum of complexity.

It is a further object of the invention to provide a center opening door elevator system utilizing a linkage, two vanes, and only one door lock.

According to the invention, a central opening, elevator door system, which has car doors operating at relatively different speeds, comprises: a first centrally operated hoistway door attached to an air cord and via a first vane to a first car door; a second hoistway door attached via a second vane to a second car door which leads the first car door, the second hoistway door having a stop in register with, but not contacting, the air cord; an abutment attaching to the air cord, the abutment contacting the stop attached to the second hoistway door when the first and second hoistway doors are closed such that the first hoistway door cannot move when the second hoistway door is locked.

The foregoing and other features and advantages of the present invention will become more apparent in light of the following detailed description of a best mode embodiment thereof and accompanying drawing.

BEST MODE FOR CARRYING OUT THE INVENTION

Figure 1:
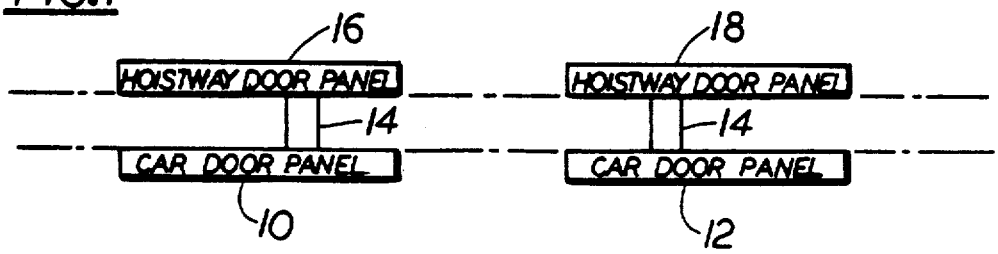
FIG. 1 shows a top view of a two vane elevator door operating system.

Referring to FIG. 1, an environment of the invention, as is known in the art, is shown. A first car door 10 and second car door 12 are each driven by any suitable linkage (not shown). At each landing (not shown), each car door is attached via a vane 14 to a respective first hoistway door 16 and a second hoistway door 18. Each hoistway door moves in register with its respective car door.

Figure 2:
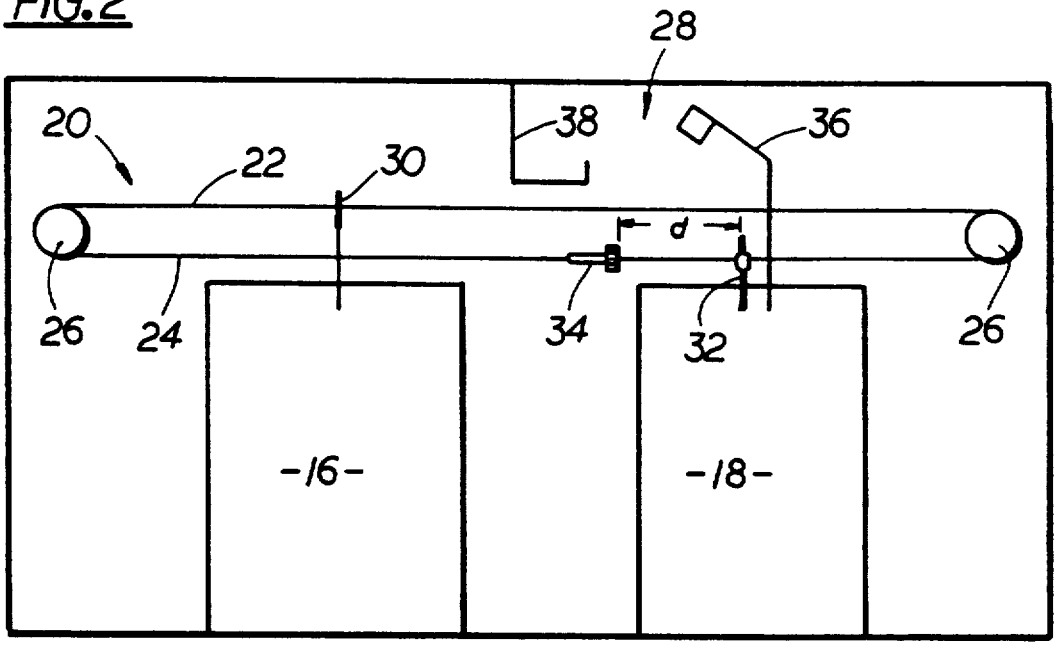
FIG. 2 shows a schematic view of an elevator door locking system of the invention in a first position.
Figure 3:
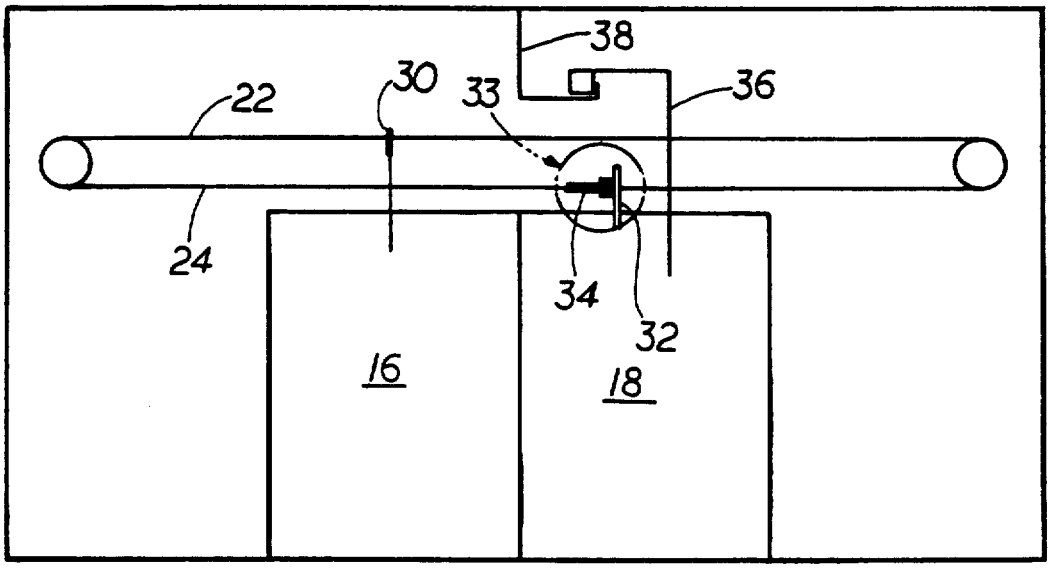
FIG. 3 shows a schematic view of an elevator door locking system of the invention in a second position.

Referring to FIGS. 2 and 3, an embodiment of the elevator door system of the invention is shown. The system comprises a continuous air cord 20 having an upper run 22 and a lower run 24, a pair of pulleys 26 about which the air cord is disposed, a door lock (shown schematically) 28, a conventional coupling 30 for attaching the first hoistway door 16 to the upper run 22 of the air cord 20, a stop 32 fixedly attached to the second hoistway door 18, and a clamp 34 attached to the lower run 24 of the air cord 20. The door lock 28 is comprised of a latch 36 and a catch 38.

Figure 4:
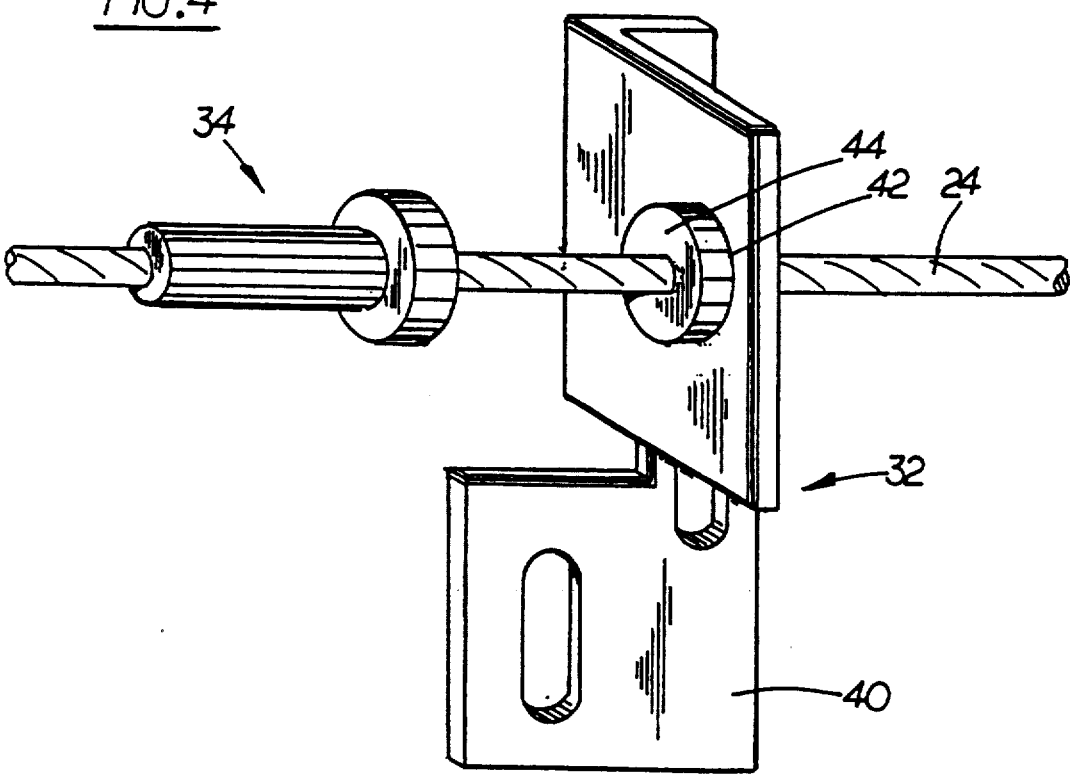
FIG. 4 is an expanded up view of FIG. 3 taken about the line 3—3.

Referring to FIG. 4, the stop 32 consists of a plate 40 which is attached by conventional means to the second hoistway door at right angles thereto. The stop has an opening 42 which encircles the lower run of the air cord. An elastomeric bumper 44 is disposed within the opening to minimize noise when the clamp 34 abuts the stop as will be discussed infra. The opening and the bumper do not interfere with the movement of the air cord relative to the stop.

The clamp 34 has a cylindrical first portion 46 of reduced diameter attaching to the lower run 24 of the air cord 20 by conventional means, and a cylindrical second portion 48 of relatively larger diameter for abutting the stop. The diameter of the second portion 48 is greater than the diameter of the opening 42 in the stop 32.

Operation

The first and second hoistway doors 16, 18 are driven towards and away from each other, as noted above, by the vanes 14 shown in FIG. 1. Because the first hoistway door 16 is attached to the air cord 20, the motion of the air cord about the pulleys is controlled by the motion of the first hoistway door. The upper run 22 of the air cord moves in register with the first hoistway door and the lower run 24 of the air cord moves in the opposite direction as the first hoistway door. The position of the clamp 34 is controlled by the motion of the air cord. Since the stop 32 encircles the air cord without engaging it, the second hoistway door 18 moves independently of the air cord.

Referring to FIG. 3, the hoistway doors are shown in a closed position. The latch 36 is closed about the catch 38, and the clamp 34 abuts the stop 36. The second hoistway door 18 is prevented from opening by the latch and catch. To open, the first hoistway door 16 must move to the left which would require the clamp to move to the right due to its connection with the lower run of the air cord. However, the clamp can not move to the right because the clamp abuts the stop and the stop can not move to the right because the connecting second hoistway door is locked by the latch and catch.

Figure 5:
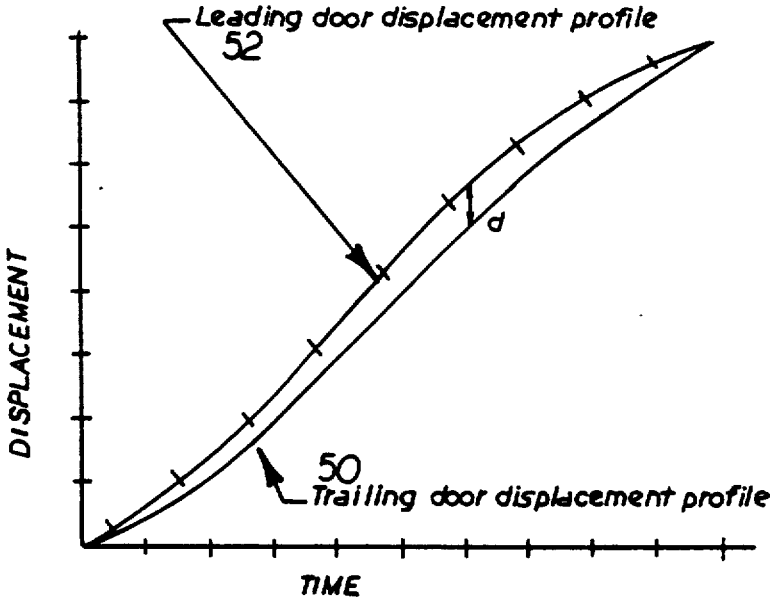
FIG. 5 is a graphical depiction of the motion profiles of the doors of FIGS. 2 and 3.

Referring now to FIG. 5, a profile of the door motion is shown. As is known in the art, due to the inherent geometries of the linkages (not shown), each car door (and each connected hoistway door) travels at a different speed relative to the other car door. Line 50 depicts the position of the first car door 10 at any given instance of time and line 52 depicts the position of the second car door 12 at any given instance of time. As may be seen in FIG. 5, the second car door leads the first car door throughout the opening and closing (i.e. the stroke) of the doors. In other words, the second car door has travelled relatively more distance d at any given time in the stroke, other than the beginning and end thereof, than the first car door. The first car door catches up to the second car door at either end of the stroke.

The relative distance concept can be illustrated by the relationship between the clamp 34 and the stop 32. At the beginning and end of the stroke, the clamp and the stop are in contact (see FIG. 3). During the stroke (see FIG. 4), the second hoistway door 18 moves a greater distance than the first hoistway door 16. As a result, the clamp and the stop separate by a distance d (shown exaggerated in FIG. 2), which is proportional to the difference in distance travelled by each car door (note that the clamp moves in the same direction as the stop because of the connection between the air cord and the first hoistway door). However at the end of each stroke, the clamp and the stop are in contact. As a result, the first hoistway door is locked if the second hoistway door is locked.

One will appreciate that, because of the relative difference in position of the doors during the stroke thereof, a door system having a linkage and two vanes can not be conventionally linked by an air cord to eliminate a door lock. However, by the disclosed arrangement herein, an air cord may be utilized to eliminate a lock.

While the present invention has been illustrated and described with respect to a particularly preferred embodiment thereof, it will be appreciated by one of ordinary skill in the art, that various modifications to this system may be made without departing from the spirit and scope of the present invention. One of ordinary skill in the art will appreciate that the present invention will be applicable to any door system which utilizes doors that operate having relatively different speed profiles.

We claim:

1. A door lock for use in an elevator system, the system having; a linkage, a first and second car door each being opened and closed by said linkage, a first and second hoistway door, a pair of vanes, each of said vanes connecting a car door to a respective hoistway door for movement therewith, said door lock comprising:

a lock attached to said second hoistway door for preventing said second hoistway door from opening, a pair of pulleys, an air cord having a continuous shape and being disposed about said pulleys, said air cord having an abutment fixedly attached thereto, means for fixedly attaching said air cord to said first hoistway door, said first hoistway way door traveling a lesser distance than said second hoistway door at any point in time of said stroke except at ends of said stroke, and a stop attached to said second hoistway door, said stop cooperating with said abutment at said ends of said stroke such that when said second hoistway door is prevented from opening by said lock, said first hoistway door is prevented from opening.

2. A door lock for use with central opening first and second elevator hoistway doors, each door being opened by a separate vane, said door lock comprising:

a lock attached to said second hoistway door for preventing said second hoistway door from opening, a pair of pulleys, an air cord having a continuous shape and being disposed about said pulleys, said air cord having an abutment fixedly attached thereto, means for fixedly attaching said air cord to said first hoistway door, said first hoistway way door traveling a lesser distance than said second hoistway door at any point in time of said stroke except at ends of said stroke, and a stop attached to said second hoistway door, said stop cooperating with said abutment at said ends of said stroke such that when said second hoistway door is prevented from opening by said lock, said first hoistway door is prevented from opening.

3. A central opening, elevator door system, which has first and second car doors operating at relatively different speeds, comprises:

an air cord;

a first centrally operated hoistway door attached to said air cord and via a first vane to said first car door;

a second hoistway door attached via a second vane to a second car door which leads the first car door, the second hoistway door having a stop in register with said air cord;

an abutment attaching to said air cord, the abutment contacting the stop attached to the second hoistway door when the first and second hoistway doors are closed such that the first hoistway door cannot move when the second hoistway door is locked.

4. A door lock for use in an elevator system, the system having; a linkage, a first and second car door each being opened and closed by said linkage, a first and second hoistway door, a pair of vanes, each of said vanes connecting a car door to a respective hoistway door for movement therewith, each car door and respective hoistway door operating at a different speed than said other car door and its respective attached hoistway door, said door lock comprising:

a lock for locking said first hoistway door;

an air cord;

a stop attaching to a second of said hoistway doors, said second hoistway door leading said first car door throughout a stroke of said doors, the stop being in register with said air cord; an abutment attaching to said air cord, the abutment contacting the stop attached to the second hoistway door when the first and second hoistway doors are closed such that the first hoistway door cannot move when the second hoistway door is locked.

5. A lock for use in a door system, the system having; a linkage, first and second drive doors each being opened and closed by said linkage, first and second driven doors, a pair of vanes, each of said vanes connecting a drive door to a respective driven door for movement therewith, each drive door and its respective driven door operating at a different speed than said other drive door and its respective driven door, said lock comprising:

a lock for locking said first driven door;

an air cord;

a stop attaching to said second driven door, said second driven door leading said first drive door throughout a stroke of said doors, the stop being in register with said air cord; an abutment attaching to said air cord, the abutment contacting the stop attached to the second driven door when the first and second driven doors are closed such that the first driven door cannot move when the second driven door is locked.

* * * * *